US010092946B2

(12) United States Patent
Bartels et al.

(10) Patent No.: US 10,092,946 B2
(45) Date of Patent: Oct. 9, 2018

(54) MOLD MATERIAL MIXTURES ON THE BASIS OF INORGANIC BINDERS, AND METHOD FOR PRODUCING MOLDS AND CORES FOR METAL CASTING

(71) Applicant: ASK Chemicals GmbH, Hilden (DE)

(72) Inventors: Dennis Bartels, Dorsten (DE); Heinz Deters, Düsseldorf (DE); Antoni Gieniec, Hilden (DE); Diether Koch, Mettmann (DE); Hannes Lincke, Köln (DE); Martin Oberleiter, Düsseldorf (DE); Oliver Schmidt, Langenfeld (DE); Carolin Wallenhorst, Düsseldorf (DE)

(73) Assignee: ASK CHEMICALS GMBH, Hilden (DE)

( * ) Notice: Subject to any disclaimer, the term of this patent is extended or adjusted under 35 U.S.C. 154(b) by 39 days.

(21) Appl. No.: 14/690,750

(22) Filed: Apr. 20, 2015

(65) Prior Publication Data

US 2015/0246387 A1 Sep. 3, 2015

Related U.S. Application Data

(63) Continuation of application No. PCT/DE2013/000610, filed on Oct. 18, 2013.

(30) Foreign Application Priority Data

Oct. 19, 2012 (DE) ..... 10 2012 020 509

(51) Int. Cl.
*B22C 1/18* (2006.01)
*B22C 9/02* (2006.01)

(52) U.S. Cl.
CPC ..... *B22C 1/18* (2013.01); *B22C 1/181* (2013.01); *B22C 1/186* (2013.01); *B22C 9/02* (2013.01)

(58) Field of Classification Search
CPC ..... B22C 9/02; B22C 1/181; B22C 1/186; B22C 1/18
See application file for complete search history.

(56) References Cited

U.S. PATENT DOCUMENTS

| | | | | |
|---|---|---|---|---|
| 2,895,838 A | | 7/1959 | Henda | |
| 3,811,907 A | | 5/1974 | Scammon | |
| 4,162,238 A | | 7/1979 | Bergna | |
| 4,226,277 A | | 10/1980 | Matalon | |
| 4,709,741 A | * | 12/1987 | Nakamura | B22C 1/18 106/38.3 |
| 5,324,355 A | | 6/1994 | Binder | |

(Continued)

FOREIGN PATENT DOCUMENTS

| | | |
|---|---|---|
| CA | 2870115 | 10/2013 |
| DE | 102012104934 | 12/2013 |

(Continued)

*Primary Examiner* — Kevin P Kerns
*Assistant Examiner* — Steven S Ha
(74) *Attorney, Agent, or Firm* — Standley Law Group LLP

(57) ABSTRACT

The invention relates to mold material mixtures on the basis of inorganic binders, for producing molds and cores for metal casting. Said mixtures consist of at least one refractory mold base material, an inorganic binder and amorphous silicon dioxide as an additive. The invention also relates to a method for producing molds and cores using said mold material mixtures.

21 Claims, 2 Drawing Sheets

(56) References Cited

U.S. PATENT DOCUMENTS

| | | | | |
|---|---|---|---|---|
| 5,641,015 | A | 6/1997 | Challand | |
| 6,139,619 | A | 10/2000 | Zaretskiy | |
| 6,299,677 | B1 | 10/2001 | Johnson | |
| 7,770,629 | B2 | 8/2010 | Weicker | |
| 8,006,745 | B2 | 8/2011 | Gerlach | |
| 8,460,453 | B2 | 6/2013 | Bohlander | |
| 2010/0173767 | A1 | 7/2010 | Koch | |
| 2010/0224756 | A1 | 9/2010 | Muller | |
| 2010/0294454 | A1 | 11/2010 | Muller | |
| 2010/0326620 | A1* | 12/2010 | Muller | B22C 1/188 164/528 |

FOREIGN PATENT DOCUMENTS

| | | | |
|---|---|---|---|
| EP | 0111398 | | 1/1987 |
| GB | 634817 | | 3/1950 |
| GB | 1029057 | | 5/1966 |
| GB | 1532847 | | 11/1978 |
| JP | 4920794 | B1 | 4/2012 |

* cited by examiner

MOLD MATERIAL MIXTURES ON THE BASIS OF INORGANIC BINDERS, AND METHOD FOR PRODUCING MOLDS AND CORES FOR METAL CASTING

CROSS-REFERENCE TO RELATED APPLICATIONS

This application is a continuation under 35 USC 120 of PCT/DE2013/000610, which is in turn entitled to benefit of a right of priority under 35 USC §120 from German patent application 102012020509.0, filed on 19 Oct. 2012. The content of both applications is incorporated by reference as if fully recited herein.

TECHNICAL FIELD

The invention relates to mold material mixtures on the basis of inorganic binders for producing molds and cores for metal casting, consisting of at least one refractory basic mold material, an inorganic binder and particulate amorphous silicon dioxide as an additive. The invention also relates to a method for producing molds and cores using said molded material mixtures.

BACKGROUND

Casting molds are essentially made up of molds or molds and cores which represent the negative shapes of the castings to be produced. Said cores and molds consist of a refractory material, for example quartz sand, and a suitable binder that imparts adequate mechanical strength to the casting following removal from the mold. The refractory mold base material is preferably present in a free-flowing form, so that it can be packed into a suitable mold cavity and compressed there. The binder produces firm cohesion between the particles of the mold base material, so that the casting mold achieves the required mechanical stability. In casting, molds from the outer walls for the casting, and cores are used to produce cavities within the casting. It is not absolutely necessary for molds and cores to be made of the same material. For example, in chill casting the shaping of the outer area of the casting is formed using metal permanent molds. A combination of molds and cores produced from mold mixtures of different compositions and using different methods is also possible. If only the term "molds" is used in the following for the sake of simplicity, the statements apply equally for cores as well which are based on the same mold mixture and produced according to the same method.

Molds can be produced using both organic and inorganic binders which may be cured by either cold or hot methods in each case.

The cold method is the name applied to methods which are performed essentially without heating the molding tool, generally at room temperature or at a temperature adequate for producing a reaction if desired. For example the curing is performed in that a gas is passed through the mold material mixture to be cured and produces a chemical reaction at this time. In hot methods the mold material mixture, after molding, for example, is heated by the hot molding tool to a sufficiently high temperature to expel the solvent present in the binder and/or to initiate a chemical reaction for curing the binder.

Because of their technical characteristics, organic binders have great financial significance on the market at the present time. Regardless of their composition, however, they have the drawback that they decompose during casting, thereby emitting considerable quantities of harmful materials such as benzene, toluene and xylenes. In addition the casting of organic binders generally leads to odor and fume nuisances. In some systems harmful emissions even occur during the manufacturing and/or storage of cores. Even though the emissions have been reduced gradually over the years by binder development, they cannot be completely avoided with organic binders. For this reason, in recent years research and development activity is again turning toward inorganic binders in order to improve them and the product properties of the molds and cores produced with them.

Inorganic binders have long been known, especially those based on the water glasses. They found their broadest use during the 1950s and 1960s, but they rapidly lost their significance with the emergence of modern organic binders. Three different methods are available for curing the water glasses:

- passing a gas, for example $CO_2$, air or a combination of the two, through them,
- addition of liquid or solid curing agents, for example esters
- thermal curing, e.g., in the hot box method or by microwave treatment.

$CO_2$ curing is described, for example, in GB 634817; curing with hot air without added $CO_2$ for example in H. Polzin, W. Tilch and T. Kooyers, Giesserei-Praxis 6/2006, p. 171. A further development of $CO_2$ curing by subsequent flushing with air is disclosed in DE 102012103705.1. Ester curing is known for example from GB 1029057 (so-called No-Bake method).

The thermal curing of water glass is discussed for example in U.S. Pat. No. 4,226,277 and EP 1802409, wherein in the latter case particulate synthetic amorphous $SiO_2$ is added to the mold material mixture to increase the strength.

Other known inorganic binders are based on phosphates and/or a combination of silicates and phosphates, wherein the curing is likewise performed according to the above-mentioned methods. The following may be mentioned in this connection as examples: U.S. Pat. No. 5,641,015 (phosphate binders, thermal curing), U.S. Pat. No. 6,139,619 (silicates/phosphate binders, thermal curing), U.S. Pat. No. 2,895,838 (silicate/phosphate binders, $CO_2$ curing), and U.S. Pat. No. 6,299,677 (silicate/phosphate binders, ester curing).

In the cited patents and applications EP 1802409 and DE 102012103705.1 it is suggested that amorphous silica be added to each of the mold material mixtures. The $SiO_2$ has the task of improving the breakdown of the cores after exposure to heat, for example after casting. In EP 1802409 B1 and DE 102012103705.1 it is illustrated extensively that the addition of synthetic particulate amorphous $SiO_2$ brings about a distinct increase in strength.

It is suggested in EP 2014392 B1 that a suspension of amorphous spherical $SiO_2$ be added to the mold material mixture, consisting of mold material, sodium hydroxide, alkali silicate-based binder and additives, wherein the $SiO_2$ should be present in two particle size classes. By this means good flowability, high bending strength and a high curing speed would be obtained.

Statement of the Problem

The goal of the present invention is to further improve the properties of inorganic binders, to make them more universally usable, and to help them become an even better alternative to the currently dominant organic binders.

In particular it is desirable to supply mold material mixtures that will make it possible to produce cores with more complex geometry based on further improved strengths and/or improved compaction, or in the case of simpler core geometries, to reduce the quantity of binder and/or shorten the curing times.

SUMMARY

This goal is accomplished by mold material mixtures with the features of the independent claims. Advantageous further developments form the subject matter of the dependent claims and will be described in the following.

Surprisingly it was found that among the amorphous silicon dioxides there are types which differ distinctly from the others in terms of their effect as an additive to the binder. If the additive added is particulate amorphous $SiO_2$ that was produced by thermal decomposition of $ZrSiO_4$ to form $ZrO_2$ and $SiO_2$, followed by essentially complete or partial removal of $ZrO_2$, it is seen that with addition of the same amount and under the identical reaction conditions, surprisingly large improvements in strength are obtained and/or the core weight is higher than when particulate amorphous $SiO_2$ from other production processes mentioned in EP 1802409 B1 is used. The increase in the core weight at identical external dimensions of the core is accompanied by a decrease in gas permeability, indicative of tighter packing of the mold material particles.

The particulate amorphous $SiO_2$ produced according to the above method is also known as "synthetic amorphous $SiO_2$." The particulate amorphous $SiO_2$ may also be described for production according to the parameters that follow, cumulatively or alternatively.

The mold material mixture according to the invention contains at least:

- a refractory mold base material,
- an inorganic binder, preferably based on water glass, phosphate or a mixture of the two,
- an additive consisting of particulate amorphous $SiO_2$, wherein this is obtained by thermal decomposition of $ZrSiO_4$ to form $ZrO_2$ and $SiO_2$.

DETAILED DESCRIPTION OF THE INVENTION

Figure 1:
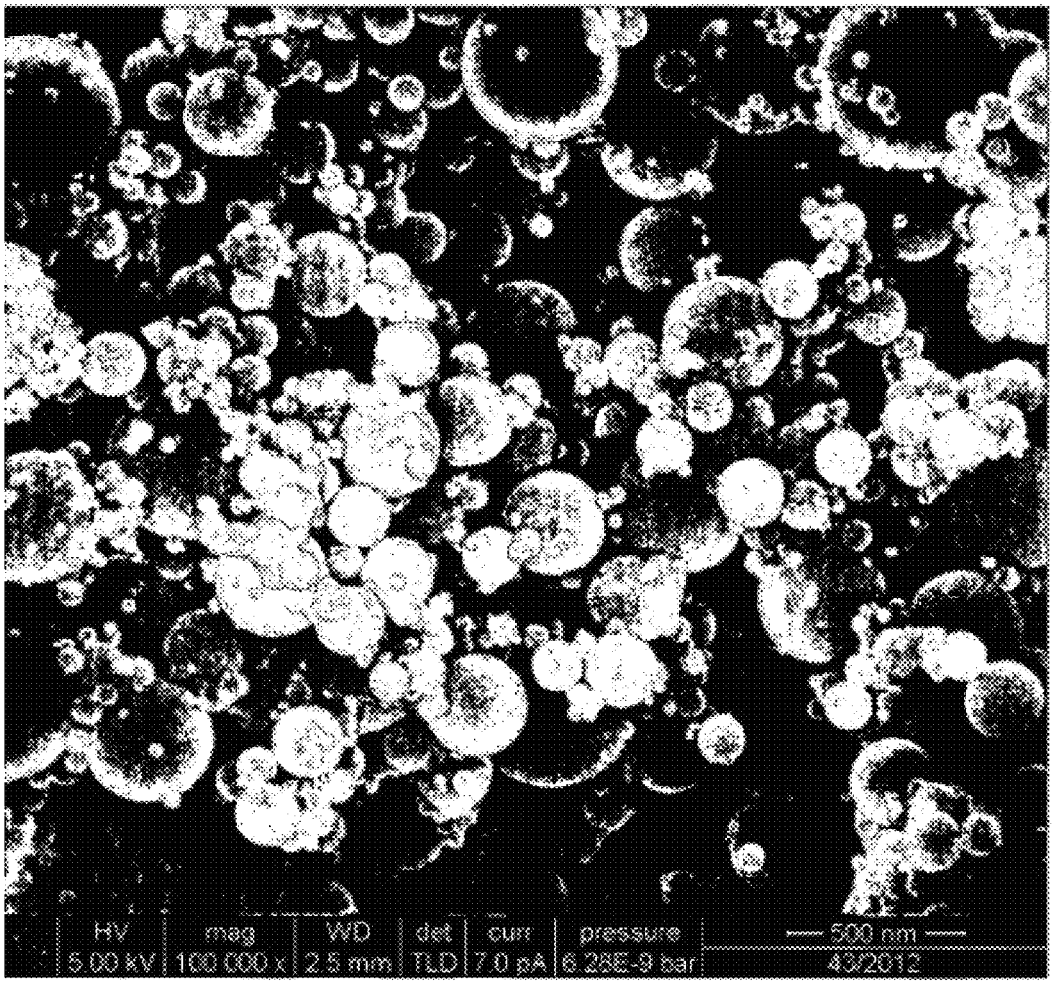
FIG. 1 is a scanning electron microscopic (SEM) image of the particulate amorphous $SiO_2$ used according to the invention.

The procedure generally followed in producing a mold material mixture is that the refractory mold base material mixture is taken initially and then the binder and the additive are added, together or one after the other, while stirring. Naturally it is also possible first to add the components completely or partially, together or separately and stir them during addition or afterwards. Preferably the binder is introduced before the additive. It is stirred until uniform distribution of the binder and the additive in the mold base material is guaranteed.

The mold base material is then brought into the desired form. In this process, customary molding methods are used. For example, the mold material mixture can be shot into the molding tool with compressed air using a core shooting machine. An additional possibility is to allow the mold material mixture to flow freely from the mixer into the molding tool and compact it there by shaking, stamping or pressing.

The curing of the mold material mixture is performed in one embodiment of the invention using the Hot Box process, i.e., it is cured with the aid of hot tools. The hot tools preferably have a temperature of 120° C., particularly preferably from 120° C. to 250° C. Preferably in this process a gas (such as $CO_2$ or $CO_2$ enriched air) is passed through the mold mixture, wherein this gas preferably has a temperature of 100 to 180° C., particularly preferably of 120 to 150° C., as described in EP 1802409 B1. The above process (Hot Box process) is preferably performed in a core shooting machine.

Independently of this, curing can also be performed in that $CO_2$, a $CO_2$/gas mixture (for example air) or $CO_2$ and a gas/gas mixture (for example air) are passed in sequence (as described in detail in DE 102012103705) through the cold molding tool or through the mold material mixture contained therein, wherein the term "cold" signifies temperatures of less than 100° C., preferably less than 50° C. and especially room temperature (for example 23° C.). The gas or gas mixture passed through the molding tool or through the mold material mixture preferably can be slightly heated, for example up to a temperature of 120° C., preferably up to 100° C., particularly preferably up to 80° C.

Last but not least, as an alternative to the two above-mentioned methods it is also possible to mix a liquid or solid curing agent with the mold material mixture before molding, and this will then produce the curing reaction.

The usual materials may be used as refractory mold base materials (simply called mold base material(s) in the following) for the production of casting molds. Suitable materials are, for example, quartz, zirconia or chromia sand, olivine, vermiculite, bauxite and fire clay. In this process it is not necessarily to use new sand exclusively. To conserve resources and avoid disposal costs it is even advantageous to use the largest possible fraction of regenerated old sand.

For example, a suitable sand is described in US 2010/173767 A1. Also suitable are regenerated materials obtained by washing and then drying. Regenerates obtained by purely mechanical treatment may also be used. As a rule the regenerates can make up at least 70 wt. % of the base mold material, preferably at least about 80 wt. % and particularly preferably at least about 90 wt. %.

As a rule the mean diameter of the mold base material is between 100 μm and 600 μm, preferably between 120 μm and 550 μm and particularly preferably between 150 μm and 500 μm. The particle size can be determined for example by screening according to DIN 66165 (part 2).

In addition, synthetic mold materials may also be used as mold base materials, especially as additives to the usual mold base materials, but also as the exclusive mold base material, such as glass beads, glass granules, the spherical ceramic mold base materials known under the name of "Cerabeads" or "Carboaccucast" or aluminum silicate micro-hollow beads (co-called microspheres). Such aluminum silicate micro-hollow beads are sold for example by Omega Minerals Germany GmbH, Norderstedt, under the name of "Omega-Spheres." Corresponding products are also available from PQ Corporation (USA) under the name of "Extendospheres."

It was found in casting experiments with aluminum that when synthetic mold base materials are used, for example in the case of glass beads, glass granules or microspheres, less mold sand remains adhering to the metal surface after casting than when pure quartz sand is used. The use of synthetic mold base materials therefore makes it possible to produce smoother cast surfaces, so that laborious after-treatment by blasting is not necessary, or at least it is needed to a considerably lesser extent.

It is not necessary for the mold base material to be made entirely of the synthetic mold base materials. The preferred fraction of the synthetic mold base materials is at least about 3 wt. %, particularly preferably at least 5 wt. %, especially preferably at least about 10 wt. %, preferably at least about 15 wt. %, particularly preferably at least about 20 wt. %, in each case based on the total amount of the refractory mold base material.

As an additional component the mold material mixture according to the invention comprises an inorganic binder, for example based on water glass. The water glasses used in this case may be conventional water glasses such as those previously used as binders in mold material mixtures.

These water glasses contain dissolved alkali silicates and can be produced by dissolving the glass-like lithium, sodium and potassium silicates in water.

The water glasses preferably have a $SiO_2/M_2O$ molar modulus in the range of 1.6 to 4.0, especially 2.0 to less than 3.5, wherein M represents lithium, sodium or potassium. The binders may also be based on water glasses that contain more than one of the alkali ions mentioned, for example the lithium-modified water glasses known from DE 2652421 A1 (=GB 1532847). In addition the water glasses may also contain multivalent ions such as boron or aluminum (corresponding products are described for example in EP 2305603 A1 (=WO2011/042132 A1).

The water glasses have a solids fraction in the range of 25 to 65 wt. %, preferably 30 to 60 wt. %. The solids fraction refers to the quantity of $SiO_2$ and $M_2O$ contained in the water glass.

Depending on the use and the desired strength level, between 0.5 wt. % and 5 wt. % of the binder based on water glass is used, preferably between 0.75 wt. % and 4 wt. %, particularly preferably between 1 wt. % and 3.5 wt. %, in each case based on the mold base material. The reported wt. % is based on water glasses with a solids fraction as mentioned above, i.e., it includes the diluent.

Instead of water glass binders, those based on water-soluble phosphate glasses and/or borates may also be used, for example as described in U.S. Pat. No. 5,641,015.

The preferred phosphate glasses have a solubility in water of at least 200 g/L, preferably at least 800 g/L and contain between 30 and 80 mol % $P_2O_5$, between 20 and 70 mol % $Li_2O$, $Na_2O$ or $K_2O$, between 0 and 30 mol % CaO, MgO or ZnO and between 0 and 15 mol % $Al_2O_3$, $Fe_2O_3$ or $B_2O_3$. The particularly preferred composition is 58 to 72 wt. % $P_2O_5$, 28 to 42 wt. % $Na_2O$ and 0 to 16 wt. % CaO. The phosphate anions are preferably present in the phosphate glasses in the form of chains.

The phosphate glasses are usually used as aqueous solutions of about 15 to 65 wt. %, preferably about 25 to 60 wt. %. However it is also possible to add the phosphate glass and the water separately to the mold base material, wherein at least part of the phosphate glass dissolves in the water during the production of the mold mixture.

Typical addition quantities for the phosphate glass solutions are 0.5 wt. % to 15 wt. %, preferably between 0.75 wt. % and 12 wt. %, particularly preferably between 1 wt. % and 10 wt. %, in each case based on the mold base material. The content statement in each case is based on phosphate glass solutions with a solids fraction as indicated above, i.e., including the diluent.

In the case of curing according to the so-called No-Bake method, the mold material mixtures preferably also contain curing agents which bring about consolidation of the mixtures without addition of heat or the need for passing a gas through the mixture. These curing agents may be liquid or solid, organic or inorganic in nature.

Suitable organic curing agents are, for example, carboxylic acid esters such as propylene carbonate, esters of monocarboxylic acids with 1 to 8 C atoms with mono-, di- or trifunctional alcohols such as ethylene glycol diacetate, glycerol mono-, di- and triacetic acid esters, as well as cyclic esters of hydroxycarboxylic acids, for example γ-butyrolactone. The esters may also be used in a mixture with one another.

Suitable organic curing agents for water glass-based binders are, for example, phosphates, such as Lithopix P26 (an aluminum phosphate from Zschimmer and Schwarz GmbH & Co KG Chemische Fabriken) or Fabutit 748 (an aluminum phosphate from Chemische Fabrik Budenheim KG).

The ratio of curing agent to binder can vary depending on the desired characteristic, for example processing time and/or stripping time of the mold material mixtures. Advantageously the fraction of curing agent (weight ratio of curing agent to binder and, in the case of water glass, the total weight of the silicate solution or other binders incorporated into solvents) is greater than or equal to 5 wt. %, preferably greater than or equal to 8 wt. %, particularly preferably greater than or equal to 10 wt. %, in each case based on the binder. The upper limits are less than or equal to 25 wt. % based on the binder, preferably less than or equal to 20 wt. %, particularly preferably less than or equal to 15 wt. %.

The mold material mixtures contain a fraction of a synthetically produced particulate amorphous $SiO_2$, wherein this originates from the process of thermal degradation of $ZrSiO_4$ to $ZrO_2$ and $SiO_2$.

Corresponding products are sold for example by the companies Possehl Erzkontor GmbH, Doral Fused Materials Pty. Ltd., Cofermin Rohstoffe GmbH & Co. KG and TAM Ceramics LLC ($ZrSiO_4$ process).

Surprisingly it has been found that particulate amorphous $SiO_2$ produced synthetically according to this method, assuming identical added quantities and reaction conditions, gives the cores higher strengths and/or a higher core weight than amorphous $SiO_2$ from other manufacturing processes, e.g., silicon or ferrosilicon production, flame hydrolysis of $SiCl_4$ or a precipitation reaction. The mold material mixtures according to the invention thus have improved flowability and can therefore be compacted more extensively at the same pressure.

Both have positive effects on the utilization properties of the mold material mixtures, since cores with more complex geometries and/or smaller wall thicknesses can be produced in this way compared to previously. In the case of simple cores without great demands imposed on the strengths, on the other hand, it is possible to reduce the binder content and thus increase the economy of the process. The improved compaction of the mold material mixture entails yet another advantage in that the particles of the mold material mixture exist in a closer bond than in the prior art, so that the core surface is more pore-free, which leads to reduced surface roughness in the casting.

Figure 2:
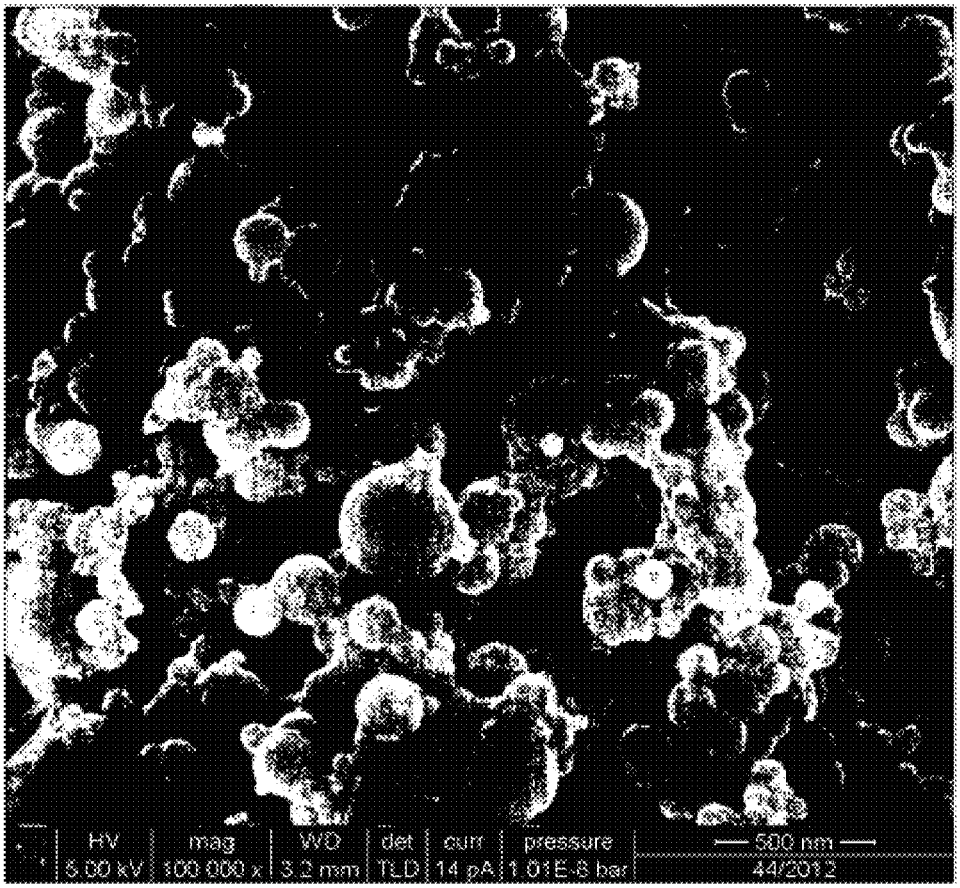
FIG. 2 is a scanning electron microscopic photograph of an amorphous $SiO_2$ not according to the invention produced during the manufacturing of silicon/ferrosilicon.

Without being bound to this theory, the inventors assume that the improved flowability is based on the fact that the particulate amorphous $SiO_2$ used in accordance with the invention has a lower tendency toward agglomeration than the amorphous $SiO_2$ from the other manufacturing processes, and therefore more primary particles are already present even without the action of strong shear forces. In FIG. 1 it can be seen that more individual particles are present in the $SiO_2$ according to the invention than in the comparison preparation (FIG. 2). In FIG. 2 it is also possible to identify a higher degree of coalescence of individual spheres into larger conglomerates, which can no longer be broken down into the primary particles. In addition the two figures indicate that the primary particles of the $SiO_2$ according to the invention have a broader particle size distribution than in the prior art, which can likewise contribute to improved flowability.

The particle size was determined by dynamic light scattering on a Horiba LA 950, and the scanning electron photomicrographs were recorded using an ultra-high resolution scanning electron microscope, Nova NanoSem 230 from FEI equipped with a Through the Lens Detector (TLD). For the SEM measurements, the samples were dispersed in distilled water and then applied to an aluminum holder covered with a copper strip before the water was evaporated. In this way details of the primary particle shape could be visualized down to the order of magnitude of 0.01 μm.

Because of the way it is made, the amorphous $SiO_2$ originating from the $ZrSiO_4$ process may still contain zirconium compounds, especially $ZrO_2$. The content of zirconium, calculated as $ZrO_2$, is usually less than about 12 wt. %, preferably less than about 10 wt. %, particularly preferably less than about 8 wt. %, and especially preferably less than about 5 wt. %, and on the other hand greater than 0.01 wt. %, greater than 0.1 wt. % or even greater than 0.2 wt. %.

In addition, for example, $Fe_2O_3$, $Al_2O_3$, $P_2O_5$, $HfO_2$, $TiO_2$, CaO, $Na_2O$ and $K_2O$ may be used with a total content of less than about 8 wt. %, preferably less than about 5 wt. % and particularly preferably less than about 3 wt. %.

The water content of the particulate amorphous $SiO_2$ used according to the invention is less than 10 wt. %, preferably less than 5 wt. % and particularly preferably less than 2 wt. %. In particular the amorphous $SiO_2$ is used as a free-flowing, dry powder. The powder is free-flowing and suitable for pouring under its own weight.

The mean particle size of the particulate amorphous $SiO_2$ preferably ranges between 0.05 μm and 10 μm, especially between 0.1 μm and 5 μm and particularly preferably between 0.1 μm and 2 μm, wherein primary particles with diameters between 0.01 μm and about 5 μm were found by SEM. The determination was done using dynamic light scattering on a Horiba LA 950.

The particulate amorphous silicon dioxide has a mean particle size of advantageously less than 300 μm, preferably less than 200 μm, particularly preferably less than 100 μm. The particle size can be determined by screen analysis. The screen residue of the particulate amorphous $SiO_2$ in the case of one passage through a screen with a mesh width of 125 μm (120 mesh) preferably amounts to no more than 10 wt. %, particularly preferably no more than 5 wt. % and most particularly preferably no more than 2 wt. %.

The screen residue is determined using the machine screening method described in DIN 66165 (part 2), wherein a chain ring is additionally used as a screening aid.

It has also proven advantageous if the residue of particulate amorphous $SiO_2$ used according to the invention upon a single passage through a screen with a mesh size of 45 μm (325 mesh) amounts to no more than about 10 wt. %, particularly preferably no more than about 5 wt. % and most particularly preferably no more than about 2 wt. % (screening according to DIN ISO 3310).

By means of scanning electron microscopic images the ratio of primary particles (not agglomerated, not intergrown and not fused particles) to secondary particles (agglomerated, intergrown and/or fused particles, including particles which (clearly) do not have a spherical shape), of the particulate amorphous $SiO_2$ can be determined. These images were obtained using an ultra-high resolution Nova NanoSem 230 scanning electron microscope from FEI, equipped with a Through the Lens Detector (TLD).

For this purpose the samples were dispersed in distilled water and then applied to an aluminum holder with a copper band adhering on before the water was evaporated. In this way details of the primary particle form can be visualized up to 0.01 μm.

The ratio of the primary particles to the secondary particles of the particulate amorphous $SiO_2$ is advantageously characterized as follows, independently of one another:

More than 20% of the particles, preferably more than 40%, particularly preferably more than 60% and most particularly preferably more than 80%, based on the total number of particles, are present in the form of essentially spherical primary particles, in each case especially with the above-mentioned limit values in the form of spherical primary particles with diameters of less than 4 μm, and particularly preferably less than 2 μm;

More than 20 vol. % of the particles, preferably more than 40 vol. %, particularly preferably more than 60 vol. % and most particularly preferably more than 80 vol. %, based on the cumulative volume of the particles, are present in the form of essentially spherical primary particles, in each case particularly with the above limit values in the form of spherical primary particles with diameters of less than 4 μm, and particularly preferably less than 2 μm. The calculation of the respective volumes of the individual particles and the cumulative volume of all particles was performed assuming spherical symmetry for each individual particle and using the diameters determined by SEM imaging for the respective particles; and More than 20 area-%, preferably more than 40 area-%, particularly preferably more than 60 area-% and most particularly preferably more than 8 area-%, based on the cumulative surface area of the particles, are present in the form of essentially spherical primary particles, in each case especially with the limit values given above, in the form of spherical primary particles with diameters of less than 4 μm and particularly preferably less than 2 μm.

The percentages were determined based on statistical evaluations of a plurality of SEM images, such as are shown in FIG. 1 and FIG. 2, wherein agglomeration/intergrowth/coalescence is only to be classified as such if the respective contours of individual adjacent spherical (coalescing) primary particles are no longer recognizable. In the case of superimposed particles, in which the respective contours of the spherical geometries are (otherwise) recognizable, classification as primary particles is made even if the view does not permit actual classification because of the two-dimensionality of the photographs. In the surface area determination, only the visible particle areas are assessed and contribute to the total.

Furthermore the specific surface of the particulate amorphous $SiO_2$ used according to the invention was determined with the aid of gas adsorption measurements under the Brunauer-Emmett-Teller method ("BET"), using nitrogen, according to DIN 66131. It was found that a correlation appears to exist between BET and compressibility. Suitable particulate amorphous $SiO_2$ used according to the invention has a BET of less than or equal to 35 $m^2/g$, preferably less than or equal to 20 $m^2/g$, particularly preferably less than or equal to 17 $m^2/g$ and most particularly preferably less than or equal to 15 $m^2/g$. The lower limits are greater than or equal to 1 $m^2/g$, preferably greater than or equal to 2 $m^2/g$, particularly preferably equal to 3 $m^2/g$ and most particularly preferably greater than or equal to 4 $m^2/g$.

Depending on the intended application and the desired strength level, between 0.1 wt. % and 2 wt. % of the particulate amorphous $SiO_2$ is used, preferably between 0.1 wt. % and 1.8 wt. % and particularly preferably between 0.1 wt. % and 1.5 wt. %, in each case based on the mold base material.

The ratio of inorganic binder to particulate amorphous $SiO_2$ used according to the invention can be varied within broad limits. This offers the opportunity to greatly vary the initial strengths of the cores, i.e., the strength immediately after removal from the molding tool, without having a substantial effect on the final strength. This is of great interest especially in light metal casting. On one hand, high initial strengths are desired here in order to transport the cores immediately after production without problems or combine them into entire core packets, and on the other hand the final strengths should not be too high in order to avoid problems in core breakdown after casting.

Based on the weight of the binder (including any diluents or solvents that may be present), the particulate amorphous $SiO_2$ is preferably present in a fraction of 2 wt. % to 60 wt. %, particularly preferably from 3 wt. % to 55 wt. % and most particularly preferably from 4 wt. % to 50 wt. %. The synthetically produced (particulate) amorphous $SiO_2$ corresponds to the particulate amorphous $SiO_2$ according to the terminology of the claims, among other things, and is especially used as a powder, in particular with a water content of less than 5 wt. %, preferably less than 3 wt. %, especially less than 2 wt. % (water content determined by the Karl Fischer method). Independently of this the loss on ignition (at 400° C.) preferably amounts to less than 6, less than 5 or even less than 4 wt. %.

The addition of the particulate amorphous $SiO_2$ used according to the invention can take place before or after or in a mixture together with the binder addition, directly to the refractory material. Preferably the particulate amorphous $SiO_2$ used according to the invention is added to the refractory material in dry form and in powder form after the binder addition.

According to a further embodiment of the invention, first a premix of the $SiO_2$ with an aqueous alkali hydroxide, such as sodium hydroxide, and optionally the binder or part of the binder is produced, and this is then mixed into the refractory mold base material. The binder or binder fraction that may still be available, not having been used for the premix, can be added to the mold base material before or after the addition of the premix or together with it.

According to a further embodiment, in addition to the particulate amorphous $SiO_2$, a synthetic particulate amorphous $SiO_2$ not in accordance with the invention but according to EP 1802409 B1 can be used, for example in a ratio of 1 to less than 1.

Mixtures of $SiO_2$ according to the invention and not according to the invention may be advantageous if the effect of the particulate amorphous $SiO_2$ is to be "attenuated." Through the addition of amorphous $SiO_2$ according to the invention and not according to the invention to the mold material mixture, the strengths and/or the compaction abilities of the casting molds can be systematically adjusted.

In an additional embodiment, in the case of an inorganic binder based on water glass, the mold material mixture according to the invention can comprise a phosphorus-containing compound. Such an additive is preferred in the case of very thin-walled sections of a casting mold and especially in the case of cores, since in this way the thermal stability of the cores of the thin-walled section of the casting mold can be increased. This is especially significant if the liquid metal encounters an inclined surface after casting and exerts a strong erosive effect there because of the high metallostatic pressure or can lead to deformations of especially thin-walled sections of the casting mold.

In this process, suitable phosphorus compounds have little or no effect on the processing time of the mold material mixtures according to the invention. One example of this is sodium hexametaphosphate. Additional suitable representatives and the quantities to be added are described in detail in WO 2008/046653, and this is therefore also incorporated in the disclosure of the present patent.

Although the mold material mixtures according to the invention already have improved flowability compared to the prior art, this can be increased even further if desired by addition of lamellar-type lubricants, for example to completely fill molding tools that have particularly narrow passages. According to an advantageous embodiment of the invention the mold material mixture according to the invention contains a fraction of lamellar type lubricants, especially graphite or $MoS_2$. The quantity of lamellar type lubricant added, especially graphite, preferably amounts to 0.05 wt. % to 1 wt. % based on the mold base material.

Instead of the lamellar-type lubricant, surface-active substances, especially surfactants, may be used, and these will likewise improve the flowability of the mold material mixture even further.

Suitable representatives of such compounds are described, for example, in WO 2009/056320, which is equivalent to US 2010/0326620 A1. In particular, surfactants with sulfuric acid or sulfonic acid groups may be mentioned here. Additional suitable representatives and the respective quantities for addition are described in detail, and this is therefore also incorporated in the disclosure of the present patent.

In addition to the components mentioned, the mold material mixture according to the invention may comprise further additives. For example, release agents may be added to facilitate removal of the cores from the molding tool. Suitable release agents may include for example calcium stearate, fatty acid esters, waxes, natural resins or special alkyd resins. As long as these release agents are soluble in the binder and do not separate from this even after prolonged storage, especially at low temperatures, they may already be present in the binder component, but they can also be part of the additive or be added to the mold material mixture as a separate component.

Organic additives may be added to improve the casting surface. Suitable organic additives are, for example, phenol-formaldehyde resins such as novolaks, epoxy resins such as bisphenol-A-epoxy resin, bisphenol F-epoxy resin or epoxidized novolaks, polyols such as polyethylene or polypropylene glycols, glycerol or polyglycerol, polyolefins such as polyethylene or polypropylene, copolymers of olefins such as ethylene and/or propylene with additional comonomers such as vinyl acetate or styrene and/or diene monomers such as butadiene, polyamides such as polyamide-6, polyamide-12 or polyamide-6,6, natural resins such as balsamic resin, fatty acid esters such as cetyl palmitate, fatty acid amides such as ethylene diamine bis-stearamide, metal soaps such as stearates or oleates of divalent or trivalent metals, or carbohydrates, for example dextrins. Carbohydrates, especially dextrins, are especially suitable. Suitable carbohydrates are described in WO 2008/046651 A1. The organic additives can be used both as the pure material and in a mixture with various other organic and/or inorganic compounds.

The organic additives are preferably added in a quantity of 0.01 wt. % to 1.5 wt. %, particularly preferably 0.05 wt. % to 1.3 wt. % and most particularly preferably 0.1 wt. % to 1 wt. %, in each case based on the mold material.

Furthermore, silanes may also be added to the mold material mixture according to the invention to increase the resistance of the cores to high atmospheric humidity and/or to water-based mold coatings. According to a further preferred embodiment the mold material mixture according to the invention therefore contains a portion of at least one silane. Suitable silanes are, for example, aminosilanes, epoxysilanes, mercaptosilanes, hydroxysilanes and ureidosilanes. Examples of suitable silanes are γ-aminopropyl-trimethoxy silane, γ-hydroxypropyl-trimethoxy silane, 3-ureidopropyl-trimethoxy silane, γ-mercaptopropyl-trimethoxy silane, γ-glycidoxypropyl-trimethoxy silane, β-(3,4-epoxycyclohexyl)-trimethoxy silane, N-β-(aminoethyl)-γ-aminopropyl-trimethoxy silane and the triethoxy analog compounds thereof. The silanes mentioned, especially the amino silanes, may also be prehdrolyzed. Typically about 0.1 wt. % to 2 wt. %, based on the binder are used, preferably 0.1 wt. % to 1 wt. %.

Additional suitable additives are alkali metal siliconates, e.g., potassium methyl siliconate, of which about 0.5 wt. % to about 15 wt. %, preferably about 1 wt. % to about 10 wt. % and particularly preferably about 1 wt. % to about 5 wt. %, based on the binder can be used.

If the mold material mixture comprises an organic additive, basically it can be added to the mixture at any time in the process of producing the mixture. The addition can take place in bulk or in the form of a solution.

Water-soluble organic additives can be used in the form of an aqueous solution. If the organic additives are soluble in the binder and can be stored in stable form without decomposition for several months therein, they can also be dissolved in the binder and thus added to the mold material together with it. Water-insoluble additives can be used in the form of a dispersion or a paste. The dispersions or pastes preferably contain water as the liquid medium.

If the mold material mixture contains silanes and/or alkali methyl siliconates, they are generally added by incorporating them in the binder in advance. However, they can also be added to the mold material as separate components.

Inorganic additives can also have a positive effect on the properties of the mold material mixtures according to the invention. For example, the carbonates mentioned in AFS Transactions, vol. 88, pp. 601-608 (1980) and/or vol. 89, pp. 47-54 (1981) increase the moisture resistance of the cores during storage, whereas the phosphorus compounds known from WO 2008/046653 (=CA 2666760 A1) increase the heat resistance of the cores when binders based on water glass are used.

Alkali borates as constituents of water glass binders are disclosed, for example, in EP 0111398.

Suitable inorganic additives, based on $BaSO_4$, for improving the casting surface are described in DE 102012104934.3 and can be added to the mold material mixture as a substitute for part or all of the organic additives mentioned in the preceding.

Additional details such as the respective quantities for addition are described in detail in DE 102012104934.3, and this is therefore also incorporated in the disclosure of the present patent.

Despite the high strengths that can be achieved with the mold material mixture according to the invention, the cores produced from these mold material mixtures have good disintegration after casting, especially in aluminum casting. The use of the cores produced from the mold material mixtures according to the invention, however, is not exclusively limited to light metal casting. The casting molds are generally suitable for the casting of metals. Such metals also include, for example, nonferrous metals such as brass or bronzes and ferrous metals.

EXAMPLES

1. Hot Curing 1.1 Experiment 1: Strengths and Core Weights as a Function of the Type of Particulate Amorphous $SiO_2$ Added.

1.1.1 Preparation of the Mold Mixtures 1.1.1.1 Without Addition of $SiO_2$

Quartz sand was placed in the bowl of a Hobart mixer (model HSM 10). While stirring, the binder was then added and in each case mixed intensively with the sand for 1 minute. The sand used, the type of the binder and the respective quantities added are shown in Table 1.

1.1.1.2 With Addition of $SiO_2$

The procedure of 1.1.1.1 was followed, except that after the addition of binder to the mold material mixture, particulate amorphous $SiO_2$ was added and this was also mixed in for 1 minute. The type of particulate amorphous $SiO_2$ and the quantities added are shown in Table 1.

TABLE 1

(Experiment 1)
Composition of the mold material mixtures

| | Quartz sand H32 [PBW] | Binder [PBW] | Amorphous $SiO_2$ [PBW] | Separately added $ZrO_2$ [PBW] | |
|---|---|---|---|---|---|
| 1.1 | 100 | 2.0[a)] | | | not according to invention |
| 1.2 | 100 | 2.0[a)] | 0.5[d)] | | not according to invention |
| 1.3 | 100 | 2.0[a)] | 0.5[e)] | | not according to invention |
| 1.4 | 100 | 2.0[a)] | 0.475[e)] | 0.025[n)] | not according to invention |
| 1.5 | 100 | 2.0[a)] | 0.475[e)] | 0.025[o)] | not according to invention |
| 1.6 | 100 | 2.0[a)] | 0.5[f)] | | according to invention |
| 1.7 | 100 | 2.0[a)] | 0.5[g)] | | according to invention |
| 1.8 | 100 | 2.0[a)] | 0.5[h)] | | according to invention |

TABLE 1-continued (Experiment 1)
Composition of the mold material mixtures

| | Quartz sand H32 [PBW] | Binder [PBW] | Amorphous $SiO_2$ [PBW] | Separately added $ZrO_2$ [PBW] | |
|---|---|---|---|---|---|
| 1.9 | 100 | 2.0[a)] | 0.5[i)] | | according to invention |
| 1.10 | 100 | 2.0[b)] | | | not according to invention |
| 1.11 | 100 | 2.0[b)] | 0.5[e)] | | not according to invention |
| 1.12 | 100 | 2.0[b)] | 0.5[f)] | | according to invention |
| 1.13 | 100 | 2.0[c)] | | | not according to invention |
| 1.14 | 100 | 2.0[c)] | 0.5[e)] | | not according to invention |
| 1.15 | 100 | 2.0[c)] | 0.5[f)] | | according to invention |

PBW = parts by weight

[a)]Alkali water glass; molar modulus approx. 2.1; solids content approx. 35 wt. %

[b)]Sodium polyphosphate solution; 52 wt.-% $(NaPO_3)n$ with n = approx. 25; 48 wt. % water

[c)]Mixture of 83 wt. % a) and 17 wt. % [b)]

[d)]Microsilica 971 U (Elkem AS; manufacturing process: production of silicon/ferrosilicon).

[e)]Microsilica white GHL DL 971 W (RW Silicium GmbH; manufacturing process: see [d)]

[f)]Microsilica POS B-W 90 LD (Possehl Erzkontor GmbH; manufacturing process: production of $ZrO_2$ and $SiO_2$ from $ZrSiO_4$)

[g)]Silica fume (Doral Fused Materials Pty., Ltd.; manufacturing process: see [f)]

[h)]Silica fume SiF-B white (Cofermin Rohstoffe GmbH & Co. KG; manufacturing process: see [f)]

[i)]Fume Silica 605 MID (TAM Ceramics LLC; manufacturing process: production of Ca-stabilized $ZrO_2$ and $SiO_2$ from $ZrSiO_4$)

[n)]Fused monoclinic zirconia- 45 μm (Cofermin Rohstoffe GmbH & Co. KG)

[o)]Calcia stabilized fused zirconia - 45 μm (Cofermin Rohstoffe GmbH & Co. KG)

1.1.1.3. With Addition of $SiO_2$ 1.1.2. Production of Test Pieces

For testing the mold material mixtures, rectangular test bars with dimensions of 150 mm×22.36 mm×22.36 mm were prepared (so-called Georg Fischer bars). A portion of a mold material mixture was transferred to the storage bin of an H 2.5 Hot Box core shooting machine from Röperwerk-Gießereimaschinen GmbH, Viersen, DE, the molding tool of which was heated to 180° C. The remainder of the respective mold material mixture was stored in a carefully closed container to protect it from drying and prevent premature reaction with the $CO_2$ present in the air until it was time to refill the core shooting machine.

The mold materials were introduced using compressed air (5 bar) from the storage bin into the molding tool. The residence time in the hot molding tool for curing the mixtures is 35 seconds. To accelerate the curing process, hot air (2 bar, 100° C. upon entry into the tool) was passed through the molding tool during the last 20 seconds. The molding tool was opened and the test bar removed. The test pieces for determining the core weights were made using this method.

1.1.3. Testing the Test Pieces 1.1.3.1 Strength Testing

To determine the bending strengths, the test bars were placed in a Georg Fischer strength tester equipped with a 3-point bending device and force needed to break the test bar was measured.

The bending strengths were determined according to the following scheme:

10 seconds after removal (hot strength)

Approx. 1 hour after removal (cold strength)

The results are presented in Table 2.

1.1.3.2 Determination of the Core Weight

Before determining the cold strengths, the Georg Fischer bars were weighed on a laboratory scale accurate to 0.1 g. The results are presented in Table 2.

TABLE 2

(Experiment 1)
Bending strengths and core weights

| # | Hot strengths [N/cm²] | Cold strengths: [N/cm²] | Core weight [g] | |
|---|---|---|---|---|
| 1.1 | 90 | 380 | 123.2 | not according to invention |
| 1.2 | 150 | 480 | 123.1 | not according to invention |
| 1.3 | 155 | 500 | 123.6 | not according to invention |
| 1.4 | 150 | 485 | 123.7 | not according to invention |
| 1.5 | 150 | 485 | 123.5 | not according to invention |
| 1.6 | 180 | 575 | 127.2 | according to invention |
| 1.7 | 185 | 600 | 127.1 | according to invention |
| 1.8 | 180 | 580 | 128.2 | according to invention |
| 1.9 | 155 | 530 | 126.2 | according to invention |
| 1.10 | 10 | 145 | 119.7 | not according to invention |
| 1.11 | 45 | 160 | 121.7 | not according to invention |
| 1.12 | 50 | 175 | 125.9 | according to invention |
| 1.13 | 95 | 405 | 122.7 | not according to invention |
| 1.14 | 145 | 500 | 121.1 | not according to invention |
| 1.15 | 160 | 550 | 125.3 | according to invention |

PBW = parts by weight

Results

It is apparent from Table 2 that the methods of production of the synthetically manufactured particulate amorphous $SiO_2$ have exerted a distinct effect on the characteristics of the cores. The cores produced with an inorganic binder and the $SiO_2$ according to the invention have higher strengths and higher core weights than the cores containing $SiO_2$ not according to the invention.

Examples 1.5 and 1.6 show that the positive effects are not based on the presence of $ZrO_2$ in the amorphous $SiO_2$ according to the invention, originating from the $ZrSiO_4$ process.

1.2 Experiment 2: Flowability of the Mold Material Mixtures as a Function of the Type of the Synthetically Produced Particulate Amorphous $SiO_2$, the Sand and the Shooting Pressure.

1.2.1 Production of the Mold Material Mixtures

The mold material mixtures were produced in analogy to 1.1.1. Their compositions are shown in Table 3.

TABLE 3

(Experiment 2)
Bending strengths and core weights

| # | Mold base material [PBW] | Cold strengths: [N/cm²] | Core weight [g] | Surfactant | |
|---|---|---|---|---|---|
| 2.1 | 100 [a)] | 2.0[d)] | 0.5[f)] | | not according to invention |
| 2.2 | 100 [a)] | 2.0[e)] | 0.5[g)] | | not according to invention |
| 2.3 | 100 [a)] | 2.0[d)] | 0.5[h)] | | according to invention |
| 2.4 | 100 [b)] | 2.0[d)] | 0.5[f)] | | not according to invention |
| 2.5 | 100 [b)] | 2.0[d)] | 0.5[h)] | | according to invention |

TABLE 3-continued (Experiment 2)
Bending strengths and core weights

| # | Mold base material [PBW] | Cold strengths: [N/cm$^2$] | Core weight [g] | Surfactant | |
|---|---|---|---|---|---|
| 2.6 | 100 [c)] | 2.0[d)] | 0.5[f)] | | not according to invention |
| 2.7 | 100 [c)] | 2.0[d)] | 0.5[h)] | | according to invention |
| 2.8 | 100 [a)] | 2.0[d)] | 0.5[f)] | 0.04[i)] | not according to invention |
| 2.9 | 100 [a)] | 2.0[d)] | 0.5[h)] | 0.04[i)] | according to invention |

PBW = parts by weight
[a)] Haltern quartz sand H 32 (Quarzwerke Frechen)
[b)] Frechen water glass F32 (Quarzwerke Frechen)
[c)] Quartz sand Sajdikove Humenece SH 21 (Quarzwerke Frechen)
[d)] Alkali water glass; molar modulus approx. 2.1; solids content approx. 40 wt. %
[e)] 1.8 PBW alkali water glass d) + 0.2 PBW NaOh (33 wt. %) corresponding to EP 2014392
[f)] Microsilica white GHL DL 971 W (RW Silicium GmbH; manufacturing process: production from silicon/ferrosilicon
[g)] Suspension of 25% nano $SiO_2$, 25% micro $SiO_2$ and 50% water corresponding to EP 2014392
[h)] Microsilica POS 90 LD (Possehl Erzkontor GmbH; manufacturing process: production of $ZrO_2$ and $SiO_2$ from $ZrSiO_4$.
[i)] Texapon EHS (Cognis)

1.2.2 Production of Test Pieces

Figure 3:
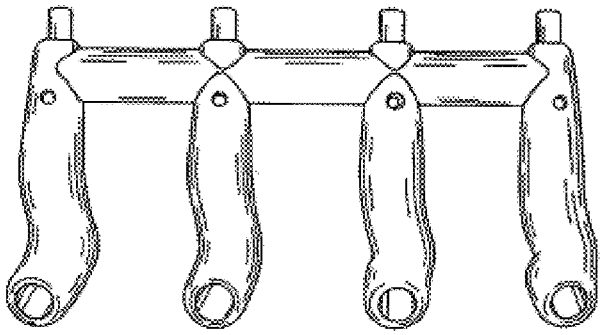
FIG. 3 is an exemplary test piece in the form of an intake port core The invention will be explained in greater detail based on the examples that follow, without being limited to them.

To investigate the effect of the synthetically produced particulate amorphous $SiO_2$ on the flowability of the mold material mixtures in further detail, cores from casting practice, so-called intake-port cores, were produced, which are larger and have more complex geometry than the Georg Fischer bars (FIG. 3).

Preliminary results had also shown that the predictive value of this experiment is greater when a practical core of complex structure is used as a test piece when the Georg Fischer flowability test, with its simple geometry, is used (S. Hasse, Gieβerei-Lexikon [Foundry Dictionary], Fachverlag Schiele and Schön). Three different sands with different particle shapes were used as mold base materials.

The mold material mixtures were transferred to the storage bin of a L 6.5 core shooting machine, Röperwerk-Gieβereimaschinen GmbH, GmbH, Viersen, DE, the molding tool of which was heated to 180° C., and from there was introduced into the molding tool using compressed air. The pressures used in this process are shown in Table 4.

The residence time in the hot tool for curing the mixtures was 35 seconds. To accelerate the curing process, hot air (2 bar, 150° C. on entry into the tool) was passed through the molding tool for the last 20 seconds.

The molding tool was opened and the test bars were removed.

1.2.3 Determination of the Core Weights

After cooling, the cores were weighed on a laboratory balance accurate to 0.1 g. The results are shown in Table 4.

TABLE 4

(Experiment 2)
Core weights of various mold material mixtures

| # | Core weight [g] 5 bar | 3 bar | 2 bar | |
|---|---|---|---|---|
| 2.1 | 1297.7 | 1280.7 | 1238.0 | not according to invention |
| 2.2 | 1290.1 | 1270.4 | 1225.7 | not according to invention |
| 2.3 | 1357.0 | 1350.7 | 1314.0 | according to invention |
| 2.4 | 1244.3 | 1232.3 | 1205.0 | not according to invention |
| 2.5 | 1295.3 | 1274.0 | 1248.3 | according to invention |

TABLE 4-continued (Experiment 2)
Core weights of various mold material mixtures

| # | Core weight [g] 5 bar | 3 bar | 2 bar | |
|---|---|---|---|---|
| 2.6 | 1354.8 | 1335.9 | 1290.0 | not according to invention |
| 2.7 | 1393.7 | 1388.5 | 1356.0 | according to invention |
| 2.8 | 1323.0 | 1319.3 | 1298.0 | not according to invention |
| 2.9 | 1373.7 | 1367.7 | 1335.3 | according to invention |

Result

Table 4 confirms, based on a core from foundry practice, the improved flowability of the mold materials according to the invention compared with the prior art. The positive effect is independent of the sand type and the shooting pressure.

Addition of a surfactant to the $SiO_2$ according to the invention results in an additional, although not so pronounced, improvement in the flowability as when amorphous $SiO_2$ from other manufacturing processes is used.

2. Curing with a Gas in Unheated Tools.

2.1 Experiment 3: Strengths and Core Weights Depending on the Type of Added Particulate Amorphous $SiO_2$.

2.1.1 Preparation of the Mold Material Mixtures

The mold material mixtures were prepared in analogy to 1.1.1. The compositions thereof are shown in Table 5.

TABLE 5

(Experiment 3)
Composition of the mold material mixtures

| # | Quartz sand H 32[a)] [PBW] | Binder[b)] [PBW] | Amorphous $SiO_2$ [PBW] | Separately added $ZrO_2$ [PBW] | |
|---|---|---|---|---|---|
| 3.1 | 100 | 2.0 | | | not according to invention |
| 3.2 | 100 | 2.0 | 0.5[c)] | | not according to invention |
| 3.3 | 100 | 2.0 | 0.475[c)] | 0.025[g)] | not according to invention |
| 3.4 | 100 | 2.0 | 0.475[d)] | 0.025[h)] | not according to invention |
| 3.5 | 100 | 2.0 | 0.5[e] | | according to invention |
| 3.6 | 100 | 2.0 | 0.5[f)] | | according to invention |
| 3.7 | 100 | 2.0 | 0.5[h)] | | according to invention |

PBW = parts by weight
[a)] Quarzwerke Frechen GmbH
[b)] Alkali water glass; molar modulus approx. 2.33; solids content approx. 40 wt. %
[c)] Microsilica 971 U (Elkem AS; manufacturing process: production of silicon/ferrosilicon)
[d)] Microsilica POS B-W 90 LD (Possehl Erzkontor GmbH; manufacturing process: production of $ZrO_2$ and $SiO_2$ from $ZrSiO_4$)
[e)] Silica fume (Doral Fused Materials Pty., Ltd.; manufacturing process: see [d)]
[f)] Fume Silica 605 MID (TAM Ceramics LLC; manufacturing process: production of Ca-stabilized $ZrO_2$ and $SiO_2$ from $ZrSiO_4$)
[g)] Fused monoclinic zirconia- 45 μm (Cofermin Rohstoffe GmbH & Co. KG)
[h)] Calcia stabilized fused zirconia - 45 μm (Cofermin Rohstoffe GmbH & Co. KG)

2.1.2 Preparation of Test Pieces

A portion of the mold material mixture produced according to 2.1.1 was transferred to the storage chamber of an H1 core shooting machine from Röperwerk-Gieβereimaschinen GmbH, GmbH, Viersen, DE. The remainder of the mold material mixture was stored in a carefully closed container to protect it from drying and prevent premature reaction with the $CO_2$ present in the air until it was time to refill the core shooting machine.

The mold materials were shot using compressed air (4 bar) into an unheated molding tool with two grooves for round cores with a diameter of 50 mm and a height of 40 mm.

2.1.2.1. Curing with a Combination of and Air

For curing, first $CO_2$ was passed through the molding tool, filled with the mold material mixture, for 6 seconds at a $CO_2$ flow rate of 2 L/min and then compressed air at a pressure of 4 bar was passed through the molding tool filled with the mold material mixture. The temperatures of the two gases were about 23° C. upon entry into the molding tool.

2.1.2.2 Curing with $CO_2$

For curing, $CO_2$ at a flow rate of 4 L/min was passed through the molding tool, filled with the mold material mixture. The temperature of the $CO_2$ was about 23° C. upon entry into the molding tool.

The gassing times with $CO_2$ are shown in Table 8.

TABLE 6

(Experiment 3)
Compressive strengths and core weights after curing with a combination of $CO_2$ and air

| # | Immediate strengths[a] [N/cm²] | Strengths after 24 h [N/cm²] | Core weight [g]] | |
|---|---|---|---|---|
| 3.1 | 56 | 238 | 141.1 | not according to invention |
| 3.2 | 173 | 289 | 143.3 | not according to invention |
| 3.3 | 193 | 280 | 143.1 | not according to invention |
| 3.4 | 189 | 300 | 143.4 | not according to invention |
| 3.5 | 214 | 383 | 151.1 | according to invention |
| 3.6 | 197 | 371 | 149.3 | according to invention |
| 3.7 | 195 | 333 | 148.4 | according to invention |

TABLE 7

(Experiment 3)
Compressive strengths after storing at elevated temperature and atmospheric humidity, curing with a combination of $CO_2$ and air

| # | Immediate strengths[b] [N/cm²] | Strengths after 24 h [N/cm²] | Strengths after 4 days [N/cm²] | Strengths after 6 days [N/cm²] | |
|---|---|---|---|---|---|
| 3.1 | 63 | 248 | 215 | 188 | not according to invention |
| 3.2 | 166 | 298 | 256 | 221 | not according to invention |
| 3.5 | 205 | 396 | 384 | 373 | according to invention |

a) Storage at 23° C./50% relative humidity
b) Storage for 24 h at 23° C./50% relative humidity, then at 30° C./80% relative humidity 2.1.2.3. Curing with Air For curing, air at a pressure of 2 bar was passed through the molding tool, filled with the mold material mixture. The temperature of the air was between about 22 and about 25° C. upon entry into the molding tool.

The gassing times with air are shown in Table 8.

TABLE 8

(Experiment 3)
Compressive strengths

| # | Gassing time [sec] | Immediate strengths[b] [N/cm²] | Strengths after 24 h [N/cm²] | |
|---|---|---|---|---|
| 3.1 | 10 | 12 | 64 | not according to invention |
| | 15 | 20 | 57 | |

TABLE 8-continued (Experiment 3)
Compressive strengths

| # | Gassing time [sec] | Immediate strengths[b] [N/cm²] | Strengths after 24 h [N/cm²] | |
|---|---|---|---|---|
| | 20 | 24 | 51 | |
| | 30 | 35 | 44 | |
| | 45 | 40 | 46 | |
| | 60 | 42 | 45 | |
| | 90 | 43 | 38 | |
| 3.2 | 10 | 33 | 67 | not according to invention |
| | 15 | 42 | 65 | |
| | 20 | 46 | 66 | |
| | 30 | 49 | 57 | |
| | 45 | 51 | 54 | |
| | 60 | 56 | 52 | |
| | 90 | 57 | 48 | |
| 3.5 | 10 | 40 | 93 | according to invention |
| | 15 | 48 | 94 | |
| | 20 | 48 | 95 | |
| | 30 | 54 | 88 | |
| | 45 | 60 | 83 | |
| | 60 | 63 | 78 | |
| | 90 | 67 | 67 | |

2.1.3 Testing the Test Pieces

After curing, the test pieces were removed from the molding tool and their compressive strengths were determined with a Zwick Universal Testing Machine (Model Z 010) immediately, i.e., a maximum of 15 seconds, after removal. In addition the compressive strengths of the test pieces were tested after 24 hours, and in some instances also after 3 and 6 days of storage in a conditioning chamber. Constant storage conditions were able to be guaranteed with a conditioning chamber (Rubarth Apparatus GmbH).

Unless stated otherwise, a temperature of 23° C. and a relative humidity of 50% were set. The values shown in the tables are mean values from 8 cores in each case. To check the compaction of the mold material mixtures during core production, in the case of combined curing with $CO_2$ and air the core weights were determined 24 h after removal from the core boxes. Weighing was performed on a laboratory balance accurate to 0.1 g.

The results of the strength tests and the core weights, to the extent that the latter were performed, are shown in Tables 6 and 7 (curing with $CO_2$ and air), table 8 (curing with $CO_2$), and Table 9 (curing with air).

TABLE 9

(Experiment 3)
Compressive strengths in case of curing with air

| # | Gassing time [sec] | Immediate strengths[b] [N/cm²] | Strengths after 24 h [N/cm²] | |
|---|---|---|---|---|
| 3.1 | 30 | 27 | 75 | not according to invention |
| | 45 | 71 | 93 | |
| | 60 | 101 | 104 | |
| 3.2 | 30 | 41 | 143 | not according to invention |
| | 45 | 88 | 222 | |
| | 60 | 123 | 273 | |
| 3.5 | 30 | 32 | 282 | according to invention |
| | 45 | 106 | 307 | |
| | 60 | 131 | 335 | |

Result

It is apparent from Tables 6-9 that the positive characteristics of the particulate amorphous $SiO_2$ compared with the prior art are not limited to hot curing (Table 2), but are also observed during curing of the mold material mixtures using a combination of $CO_2$ and air, using $CO_2$, and using air.

3. Cold Curing 3.1 Experiment 4: Strengths and Core Weights Depending on the Type of Particulate Amorphous $SiO_2$ Added 3.1.1 Production of Mold Material Mixtures 3.1.1.1 Without Addition of $SiO_2$ Quartz sand from Quarzwerke Frechen GmbH was filled into the bowl of a Hobart mixer (model HSM 10). Then while stirring, first the curing agent and then the binder were added, and in each case stirred intensively with the sand for 1 minute.

The respective quantities added, as well as the type of curing agent and binder, are presented in the individual experiments.

3.1.1.2 With Addition of $SiO_2$

The procedure as under 3.1.1 was followed, with the difference that after the binder addition to the mold material mixture, the particulate amorphous $SiO_2$ was also added and this was likewise mixed in for 1 minute. The quantity added, and the type of particulate amorphous $SiO_2$, are presented for the individual experiments.

3.1.2 Preparation of Test Pieces

The compositions of the mold material mixtures used for preparing the test pieces are presented in parts by weight (PBW) in Table 10.

For testing the mold material mixtures, rectangular test bars with dimensions of 220 mm×22.36 mm×22.36 mm were produced (so-called Georg Fischer bars). Part of a mixture prepared according to 3.1.1 was introduced manually into a molding tool with 8 grooves was introduced manually into a molding tool and compressed by pressing with a manual plate.

The processing time, i.e., the time within which a mold material mixture can be compacted without difficulty, was determined visually. The fact that the processing time has been exceeded can be recognized when a mold material mixture no longer flows freely, but rolls up like a furrow slice. The processing times for the individual mixtures are presented in Table 10.

To determine the stripping time ((ST), i.e., the time after which a mold material mixture has solidified to the point where it can be removed from the molding tool, a second part of the respective mixture was packed by hand into a round mold 100 mm in height and 100 mm in diameter, and likewise compressed with a manual plate. Then the surface hardness of the compressed mold material mixture was tested at certain time intervals with the Georg Fischer surface hardness tester. As soon as a mold material mixture is so hard that the test ball no longer penetrates into the core surfaces, the stripping time has been reached. The stripping times of the individual mixtures are presented in Table 10.

TABLE 10

(Experiment 4)
Composition of the mold material mixtures

| # | Quartz sand H 32[a] [PBW] | Binder [b] [PBW] | Catalyst [PBW] | Amorphous $SiO_2$ [PBW] | |
|---|---|---|---|---|---|
| 4.1 | 100 | 2.5 | 0.35[c] | | not according to invention |
| 4.2 | 100 | 3.0 | 0.35[c] | | not according to invention |
| 4.3 | 100 | 2.5 | 0.35[c] | 0.5[e] | not according to invention |
| 4.4 | 100 | 2.5 | 0.35[c] | 0.5[f] | according to invention |
| 4.5 | 100 | 2.5 | 0.35[c] | 0.5[g] | according to invention |
| 4.6 | 100 | 2.5 | 0.35[c] | 0.5[h] | according to invention |
| 4.7 | 100 | 2.5 | 0.35[d] | | not according to invention |
| 4.8 | 100 | 2.5 | 0.35[d] | | not according to invention |
| 4.9 | 100 | 2.5 | 0.35[d] | 0.5[e] | not according to invention |
| 4.10 | 100 | 2.5 | 0.35[d] | 0.5[f] | according to invention |
| 4.11 | 100 | 2.5 | 0.35[d] | 0.5[g] | according to invention |

PBW = parts by weight

[a] Quarzwerke Frechen GmbH

[b] Nuclesil 50 (Cognis)

[c] Catalyst 5090 (ASK Chemicals GmbH), ester mixture

[d] Lithopix P26 (Zschimmer & Schwarz

[e] Microsilica 971 U (Elkem SA; manufacturing process: production of silicon/ferrosilicon)

[f] Microsilica POS B-W 90 LD (Possehl Erzkontor GmbH; manufacturing process: production of $ZrO_2$ and $SiO_2$ from $ZrSiO_4$)

[g] Silica fume (Doral Fused Materials Pty., Ltd.; manufacturing process: see [f])

[h] Fume Silica 605 MID (TAM Ceramics LLC; manufacturing process: production of Ca-stabilized $ZrO_2$ and $SiO_2$ from $ZrSiO_4$)

3.1.3 Testing of Test Pieces 3.1.3.1. Strength Testing

To determine the bending strengths, the test bars were placed in a Georg Fischer Strength Testing Machine equipped with a 3-point bending device and the force that lead to breakage of the test bars was measured.

The bending strengths were determined according to the following schemes:

4 hours after core production 24 hours after core production,

The results are presented in Table 10

3.1.3.2. Determination of the Core Weight

Before the strengths were determined, the Georg Fischer bars were weighed on a laboratory balance accurate to 0.1 g. The results are presented in Table 10.

Results

Table 11 shows the positive effects of the particulate amorphous $SiO_2$ addition in terms of strength and core weight in cold curing with an ester mix (Examples 4.1-4.6) and a phosphate curing agent (Examples 4,7-4.11) compared with the prior art.

TABLE 11

(Experiment 4)
Bending strengths and core weights

| | PT[a)]/ ST[b)] [min] | Strengths after 4 h [N/cm$^2$] | Strengths after 4 h [N/cm$^2$] | Core weight [g] | |
|---|---|---|---|---|---|
| 4.1 | 15/80 | 145 | 250 | 119.5 | not according to invention |
| 4.2 | 17/85 | 125 | 265 | 117.0 | not according to invention |
| 4.3 | 4/75 | 185 | 290 | 119.7 | not according to invention |
| 4.4 | 3/70 | 215 | 425 | 125.5 | according to invention |
| 4.5 | 5/70 | 250 | 475 | 124.9 | according to invention |
| 4.6 | 7/80 | 210 | 385 | 123.8 | according to invention |
| 4.7 | 3/80 | 175 | 270 | 115.8 | not according to invention |
| 4.8 | 4/85 | 160 | 290 | 115.0 | not according to invention |
| 4.9 | 3/65 | 195 | 335 | 116.0 | not according to invention |
| 4.10 | 4/60 | 210 | 415 | 121.3 | according to invention |
| 4.11 | 4/60 | 215 | 415 | 120.1 | according to invention |

What is claimed is:

1. A mixture for producing molding forms and cores for metal processing, comprising:

a refractory mold base material;

an inorganic binder; and a particulate amorphous $SiO_2$, obtained by thermal decomposing $ZrSiO_4$ to $ZrO_2$ and $SiO_2$, such that the particulate amorphous $SiO_2$ comprises zirconium compounds, calculated as $ZrO_2$, in an amount of greater than 0.01 wt. % to smaller than 12 wt. %.

2. The mixture of claim 1, wherein the particulate amorphous $SiO_2$ has a Brunauer-Emmett-Teller surface area in the range of from 1 m$^2$/g to 35 m$^2$/g.

3. The mixture of claim 2, wherein the particulate amorphous $SiO_2$ has a mean particle size (diameter), as determined by dynamic light scattering that is between 0.05 μm and 10 μm.

4. The mixture of claim 1, wherein the particulate amorphous $SiO_2$ is present at 0.1 to 2 wt. %, based on the weight of the refractory mold base material.

5. The mixture of claim 1, wherein the particulate amorphous $SiO_2$ has a water content of less than 10 wt. %.

6. The mixture of claim 1, wherein the mixture contains organic compounds at a maximum of 1 wt. %.

7. The mixture of claim 1, wherein the inorganic binder is selected from the group consisting of: water-soluble phosphate glass, a water-soluble borate and water glass with a $SiO_2/M_2O$ molar ratio in the range of 1.6 to 4.0, wherein M represents lithium, sodium and potassium.

8. The mixture of claim 1, further comprising water glass in the amount of 0.5 to 5 wt. % water glass, based on the refractory mold base material, the solids fraction of the water glass amounting to 25 to 65 wt. %.

9. The mixture of claim 1, further comprising at least one anionic surfactant.

10. The mixture of claim 9, wherein the anionic surfactant is present in a fraction of 0.001 to 1 wt. %, based on the weight of the refractory mold base material.

11. The mixture of claim 1, further comprising graphite.

12. The mixture of claim 1, further comprising at least one phosphorus-containing compound.

13. The mixture of claim 1, wherein the particulate amorphous $SiO_2$ is used as a powder.

14. The mixture of claim 1, further comprising a curing agent.

15. A method for producing a casting mold or cores, comprising the steps of:

preparing a mold material mixture according to claim 1;

placing the prepared mold material mixture into a mold, and curing the prepared mold material mixture in the mold.

16. The method of claim 15, in which the step of placing the mold material mixture into the mold is achieved with a core shooting machine using compressed air, where the mold is a molding tool that has one or more gases flowing through it.

17. The method according to claim 15, wherein the curing step is practiced by exposing the mold material mixture to a temperature of at least 100° C. for less than 5 min.

18. The mixture of claim 1, wherein the particulate amorphous $SiO_2$ has a Brunauer-Emmett-Teller surface area in the range of from 1 m$^2$/g to 17 m$^2$/g.

19. The mixture of claim 18, wherein the particulate amorphous $SiO_2$ has a mean particle size (diameter), as determined by dynamic light scattering that is between 0.1 μm and 5 μm.

20. The mixture of claim 1, wherein the particulate amorphous $SiO_2$ is present at 2 to 60 wt. %, based on the weight of the inorganic binder, wherein the solids fraction of the inorganic binder amounts to 25 to 65 wt. %.

21. A mixture for producing molding forms and cores for metal processing, comprising:

a refractory mold base material;

an inorganic binder based on water glass with a $SiO_2/M_2O$ molar ratio in the range of 1.6 to 4.0, wherein M represents lithium, sodium and potassium; and a particulate amorphous $SiO_2$ that is obtained by thermal decomposing $ZrSiO_4$ to $ZrO_2$ and $SiO_2$, such that the particulate amorphous $SiO_2$ has a mean particle size (diameter), as determined by dynamic light scattering that is between 0.05 μm and 10 μm, the particulate amorphous $SiO_2$ being present at an amount of from 0.1 to 2 wt. %, with the particulate amorphous $SiO_2$ comprising zirconium compounds, calculated as $ZrO_2$, in an amount of greater than 0.01 wt. % to smaller than 12 wt. %, based on the total weight of the amorphous $SiO_2$.

* * * * *